US005103111A

United States Patent [19]

Tobin et al.

[11] Patent Number: 5,103,111

[45] Date of Patent: Apr. 7, 1992

[54] SWITCH CONFIGURATION WITH INTEGRAL SENSING AND POWER SUPPLY APPARATUS

[75] Inventors: Thomas J. Tobin, Northbrook; Leonard V. Chabala, Maywood; Joel A. Ramos, Chicago, all of Ill.

[73] Assignee: S&C Electric Company, Chicago, Ill.

[21] Appl. No.: 331,311

[22] Filed: Mar. 30, 1989

[51] Int. Cl.[5] ..... H01H 31/00

[52] U.S. Cl. ..... 307/130; 200/48 P; 200/48 A; 307/131

[58] Field of Search ..... 307/112, 125, 126, 130, 307/131; 200/48 R, 400, 48 A, 48 P

[56] References Cited

U.S. PATENT DOCUMENTS

| | | | |
|---|---|---|---|
| 2,658,976 | 11/1953 | Hoye | 200/145 |
| 3,671,688 | 6/1972 | Nitta | 200/48 R |
| 3,689,777 | 9/1972 | Nitta | 307/140 |
| 4,002,976 | 1/1977 | Zulaski | 336/70 |
| 4,228,475 | 10/1980 | Sherwood | 361/47 |
| 4,241,373 | 12/1980 | Mara et al. | 361/92 |
| 4,293,834 | 10/1981 | Date et al. | 335/76 |
| 4,536,822 | 8/1985 | Osborne | 200/48 D |
| 4,596,906 | 6/1986 | Chabala et al. | 200/48 R |
| 4,626,953 | 12/1986 | Nilssen | 361/63 |
| 4,752,859 | 6/1988 | Chabala et al. | 200/48 R |
| 4,775,849 | 10/1988 | Lucas | 336/90 |
| 4,808,910 | 2/1989 | Kessi | 323/358 |
| 4,823,022 | 4/1989 | Lindsey | 307/149 |

OTHER PUBLICATIONS

GW5-CLP-81A, G&W CLP Current Limiting Protector, 4 pp, G&W Electric Co. Blue Island, Ill. 60406, 312/388-5010.

GW20-SG4-21, Mar. 1984, G&W Current Limiting Protector, 4 pp, G&W Electric Co. Blue Island, Ill. 60406, 312/388-5010.

*Primary Examiner*—A. D. Pellinen
*Assistant Examiner*—Jeffrey A. Gaffin
*Attorney, Agent, or Firm*—James V. Lapacek

[57] ABSTRACT

A multi-pole group-operated switch configuration is provided for electrical distribution circuits. The switch configuration includes integral arrangements for sensing circuit parameters and supplying power for a switch operator of the switch configuration. The switch configuration includes a plurality of switch-pole units. In accordance with desired characteristics and features, one or more of the switch-pole units includes an integral current-sensing device, an integral voltage-sensing device, or an integral combination voltage and current-sensing device. The voltage-sensing device also provides operating power to power a switch operator and charge the batteries of the switch configuration.

18 Claims, 1 Drawing Sheet

SWITCH CONFIGURATION WITH INTEGRAL SENSING AND POWER SUPPLY APPARATUS

CROSS REFERENCE TO RELATED APPLICATION

The switch and switch configuration of co-pending application Ser. No. 07/331,216 filed on Mar. 30, 1989 in the name of of Rogers et al (now U.S. Pat. No. 4,983,792) is, useful in conjunction with the present invention and that application is hereby incorporated by reference for all purposes.

BACKGROUND OF THE INVENTION

1. Field of the Invention

The present invention relates generally to the field of electrical switches and circuit interrupters, and more particularly to a multi-pole group-operated switch configuration for electric power distribution circuits that includes integral circuit-parameter sensing and power supply arrangements such that the switch configuration is self-contained and requires no external 2. Description of the Related Art Various switches and circuit interrupters are known as illustrated, for example, by U.S. Pat. Re. Nos. 27,625; 4,596,906; and 4,752,859. Additionally, various devices and arrangements are known for sensing current and voltage present in electrical distribution circuits; e.g. see U.S. Pat. Nos. 4,351,994, 4,002,976 and 4,700,123.

While the arrangements of the prior art provide useful features, they require external connections and/or distinctly separate devices to obtain signals representing the voltage and current in electrical distribution circuits and a supply of power to operate the switches of the particular switch configuration. In addition to requiring additional components and space, the prior art arrangements are also dependent on the reliability of an external power supply and the external wiring and component connections for both the sensing of parameters that are required to determine appropriate switch operation and for the actual operation of the switch.

SUMMARY OF THE INVENTION

Accordingly, it is a principal object of the present invention to provide a multi-pole group-operated switch configuration for electrical distribution circuits wherein the configuration includes integral arrangements to sense circuit parameters and to supply operating power for the switch configuration with the integral arrangements being operated solely from the distribution circuit.

It is another object of the present invention to provide a switch configuration that is totally self-contained and that requires no external power for operation of the switch configuration.

It is a further object of the present invention to provide a multi-pole switch configuration for electrical distribution circuits wherein the switch configuration includes arrangements for sensing circuit parameters and providing operating power for a switch operator; the arrangement being integral with portions of one or more of the switch-pole units of the switch configuration.

These and other objects of the present invention are efficiently provided by a multi-pole group-operated switch configuration for electrical distribution circuits. The switch configuration includes integral arrangements for sensing circuit parameters and supplying power for a switch operator of the switch configuration. The switch configuration includes a plurality of switch-pole units. In accordance with desired characteristics and features, one or more of the switch-pole units includes an integral current-sensing device, an integral voltage-sensing device, or an integral combination voltage and current-sensing device. The voltage-sensing device also provides operating power to power a switch operator and charge the batteries of the switch configuration.

BRIEF DESCRIPTION OF THE DRAWING

The invention, both as to its organization and method of operation, together with further objects and advantages thereof, will best be understood by reference to the specification taken in conjunction with the accompanying drawing in which like reference characters refer to like elements and in which.

DETAILED DESCRIPTION

Figures 1, 2:
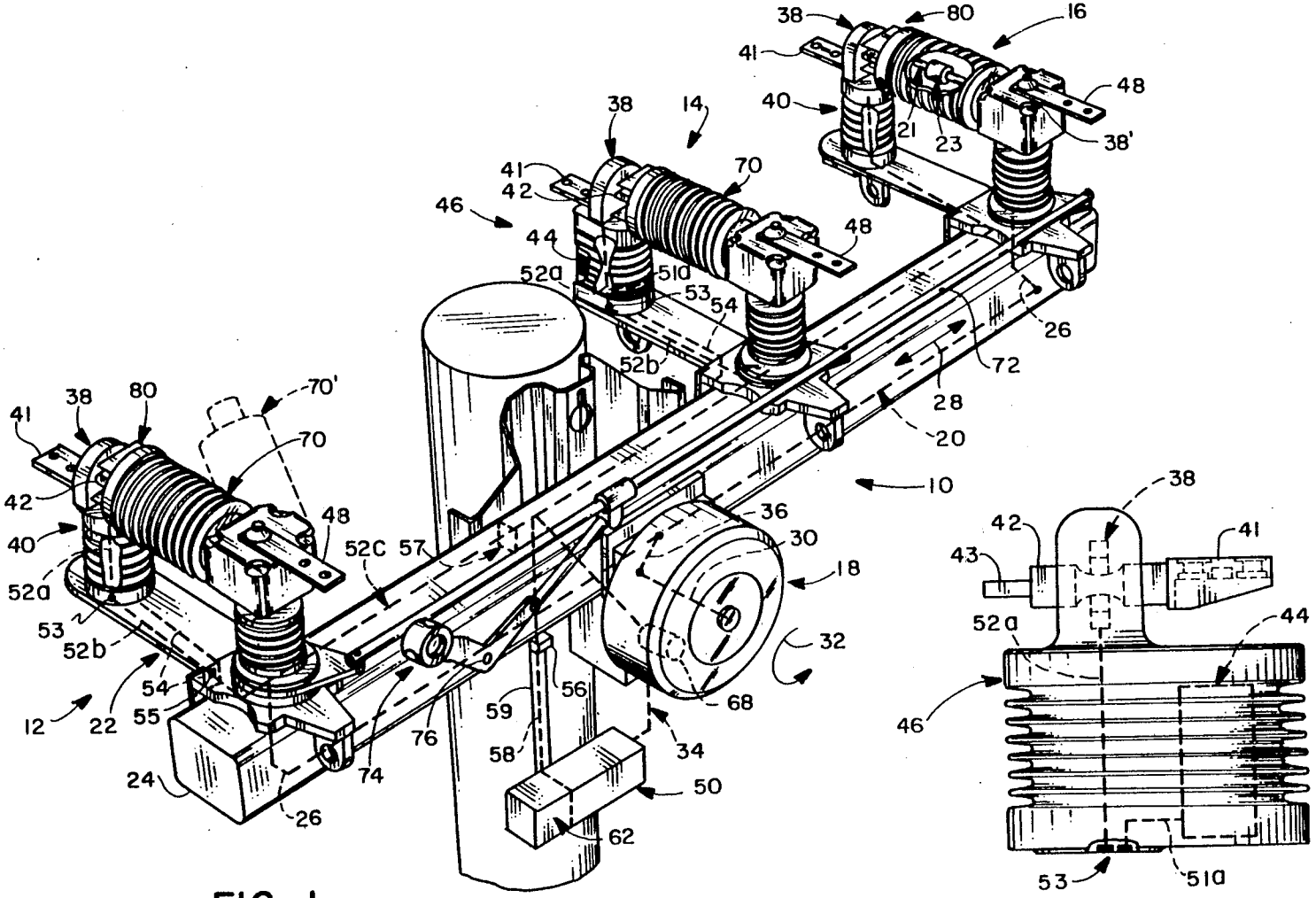
FIG. 1 is a perspective view of a multi-pole group operated switch configuration according to the present invention.
FIG. 2 is an elevational view of an integral circuit-parameter sensing arrangement for use with the switch configuration of the present invention.

Referring now to FIG. 1, a multi-pole group-operated switch configuration 10 according to the present invention is illustrated for use in electrical power distribution circuits. The illustrative switch configuration 10 utilizes three switch-pole units 12, 14 and 16. For example, and not to be interpreted in any limiting sense, the switch-pole units 12, 14 and 16 are generally of the type illustrated in co-pending application Ser. No. 07/331,216. The switch configuration 10 also includes an operator 18 which operates a drive train 20 that is operatively coupled to each of the switch-pole units 12, 14 and 16 for operation thereof. In accordance with important aspects of the present invention, the switch-pole units 12, 14 and 16 include various circuit parameter sensing and power supply arrangements integral to the switch-pole units 12, 14, and 16. These integral arrangements provide appropriate information to determine when the switch configuration 10 is to be operated to open the circuit path established by each of the switch-pole units 12, 14, and 16. Additionally, these integral arrangements also provide operating power to the operator 18. While the switch configuration 10 will be used as an illustrative example to describe the present invention, it should be realized that the present invention is useful in conjunction with various switch configurations having various combinations of mounting patterns, spacing, and orientations as well as various switch-pole units having diverse circuit-interrupting and/or disconnect contacts.

In any case, considering the specific illustrative embodiment of FIG. 1, a support base 22 of each of the switch-pole units 12, 14, and 16 is affixed to a tubular support member 24 via suitable fasteners (not shown). An operating lever arm 26 of each of the switch-pole units 12, 14, and 16 is connected to the drive train referred to at 20. For example, as illustrated by the bi-directional arrows 28, movement of the drive train 20 to the right opens a pair of separable interrupting contacts 21,23 of each of the switch-pole units 12, 14 and 16, and movement to the left closes the separable interrupting contacts. The drive train 20 is operated at high speeds by the operator 18. The operator 18 is of the type which rapidly rotates an output shaft generally referred to at 30, for example, in a direction 32 to selectively open or close the switch-pole units 12, 14, and 16. This type of operator 18 is often referred to as having "quick-make quick-break" capability in that the drive train 20 may be rapidly sequenced to the left, then to the right. The operator 18 receives control information at 34 to determine when the shaft at 30 is to be rotated to open or close the switch-pole units 12, 14, and 16. Operators of this type commonly use one or more springs to store energy; the spring or springs being charged via an electric motor or the like In any case, the rotation in the direction 32 is translated via the interconnection linkage at 36 into movement either to the right or to the left by the drive train 20. For example, if the switch-pole units 12, 14, and 16 are in the closed position, rotation of the drive shaft 30 will open the separable interrupting contacts 21,23 in each of the switch-pole units 12, 14, and 16 by movement of the drive train 20 to the right. Subsequent rotation of the drive shaft 30 results in closing of the interrupter contacts 21,23 via movement of the drive train 20 to the left.

Each of the switch-pole units 12,16 includes a support insulator 40 having integrally incorporated therewith an integral current-sensing device referred to at 38 and a circuit terminal conductor 42. The circuit terminal conductor 42 also includes an affixed first circuit terminal 41 to define a first terminal. The switch-pole unit 14 includes an integral current-sensing device 38 and an integral voltage-sensing device 44 (also referred to as a potential device) which are integrally incorporated within a support insulator 46 along with a circuit terminal conductor 42. Each of the support insulators 40 and 46 with integral circuit-parameter sensing devices can also be referred to as a composite of an insulative support, circuit parameter devices and a circuit terminal arrangement.

Referring now additionally to FIG. 2, in a preferred arrangement, the current-sensing device 38 is integrally incorporated about the circuit terminal conductor 42 during a molding process wherein the circuit terminal conductor 42, the current-sensing device 38, the voltage-sensing device 44, and signal conductors 51*a* and 52*a* are integrally incorporated into the support insulator 46 The signal conductors 51*a* and 52*a* connect the outputs of the voltage-sensing device 44 and the current-sensing device 38 respectively to the lower end of the support insulator 46 at output terminals 53. The support insulator 46 of FIG. 2 illustrates one particular design as set forth in copending application Ser. No. 07/331,570 filed on Mar. 30, 1989 in the names of H. Scherer et.al. In the preferred embodiment, the support insulators 40 and 46 are molded from a cycloaliphatic resin.

A respective second circuit terminal 48 is also provided on each of the switch-pole units 12, 14, and 16; the circuit path of each pole or phase of the switch configuration 10 being defined between the first and second circuit terminals 41,48 and including the separable interrupting contacts 21,23 carried by each of the switch-pole units 12, 14 and 16. Each of the circuit terminals 41,48 is respectively connected to one of the separable interrupting contacts 21,23. Current-sensing information from each of the current-sensing devices 38 is communicated to an RTU (remote terminal unit) 50 via conductors referred to generally at 52. Specifically, signal conductors 52*a* communicate through the support insulators 40,46 and exit the insulators at the terminals 53. Additionally, signal conductors 52*b* communicate from the terminals 53 through a conduit or passage 54 that extends along each support base 22 and into the support member 24. In a specific embodiment, terminals or electrical connectors 55 are provided at the interface of the support member 24 and the support base 22. Conductors 52*c* communicate within and along the support member 24 from the terminals 55 to a connector at 56 for connection to the RTU 50; the conductors 52*c* passing through a conduit, passage, or like guiding arrangement 57 provided within the support member 24. Signal conductors 58 within a conduit 59 connect the circuit-parameter sensing signals from the connector 56 to the RTU 50 In this manner, mechanical and electrical shielding of the signal conductors 52 is provided. The signal conductors 52*c* are also connected to supply operating power to a motor 68 of the operator 18. The signals present on the signal conductors 52*c* are connected to the RTU 50 to provide sensed voltage information of the voltage at the first terminal 41 of the switch-pole unit 14, to provide charging of a battery 62 contained within the RTU 50, and to provide sensed current information of the current passing through each of the circuit terminal conductors 42 of each of the switch-pole units 12, 14 and 16. The RTU 50 communicates the sensed current and voltage information to a substation or the like via a communication link; e.g., radio. The RTU 50 also receives information from a substation via the communication link to provide operating control signals on conductors 34, for example, to control the operator 18 to rotate the shaft 30 when switch operation is desired. In one specific arrangement, the sensed circuit-parameter signals on the conductor 52*c* is utilized to provide control of the operator 18 for switch operation.

In the specific switch configuration 10, each switch-pole unit 12, 14, and 16 includes separable interrupting contacts 21,23 within an interrupter 70; the separable interrupting contacts 21,23 being operable via the drive train 20. Additionally, each of the interrupters 70 is rotatably mounted with respect to the support base 22 so as to be movable to the position 70, to provide a disconnect function as explained in more detail in the aforementioned co-pending application Ser. No. 07/331,216. Each of the interrupters 70 includes a housing fabricated from insulating material.

Specifically, a disconnect drive link 72 is driven by a disconnect control generally referred at 74. The disconnect control 74 is operated via a hookstick or the like—although of course in other embodiments, it could define a motor-driven output or a linkage for remote manual operation. The disconnect control 74 includes a crank arm 76 that is pivotally mounted at 78 and coupled to the drive link 72. Movement of the crank arm 76 provides corresponding movement of the drive link 72 to rotate the interrupter 70 of each of the switch pole units 12, 14, and 16. Accordingly, if the interrupter switch pole units 12, 14 or 16 are each in the closed position as shown, the crank arm 76 will be in the position as shown. When a visible circuit isolation position is desired, the crank arm 76 is moved downward to the left to the phantom position 76' and the interrupters 70 are rotated to the phantom position 70' such that a jaw contact 80 carried by the interrupter 70 is disconnected and physically separated from a stationary contact 43 (FIG. 2) carried by the circuit terminal conductor 42. Correspondingly, movement of the crank arm 76 back to the position as shown results in the connection of the jaw contact 80 to the conductor 42.

The interrupter 70 and the support insulator 40 or 46 provide suitable insulation between the first and second circuit terminals 41,48 and also with respect to the support base 22.

While there have been illustrated and described various embodiments of the present invention, it will be apparent that various changes and modifications will occur to those skilled in the art. For example, in one specific alternate arrangement, a current-sensing device 38, is integrally incorporated with the interrupter 70 so as to sense current flowing between the first and second circuit terminals 41 and 48. In another specific arrangement, a voltage-sensing device 44 is provided with either the insulator 46 or the interrupter 70—with or without a current-sensing device. In yet another specific arrangement, the current-sensing device 38 is positioned adjacent the terminal conductor 42 rather than around the terminal conductor 42. Additionally, each switch-pole can include any combination of circuit-parameter sensing devices (or no circuit-parameter sensing devices), such as an integral current-sensing device, one or more integral voltage-sensing devices, or an integral combination voltage and current-sensing device. It is intended in the appended claims to cover all such changes and modifications as fall within the true spirit and scope of the present invention.

What is claimed and desired to be secured by Letters Patent of the United States is:

1. A switch for electric power distribution circuits comprising:

a pair of separable contacts;

means for defining first and second circuit terminals, each of said separable contacts being connected to a respective one of said circuit terminals;

a support base;

means for insulating and supporting the separable contacts and the first and second circuit terminals with respect to said support base;

means for separating and connecting said separable contacts; and means integrally incorporated with said insulating and supporting means for sensing one or more circuit parameters with respect to the circuit parameters at the first and/or second circuit terminals, said insulating and supporting means comprising a molded insulating support that is affixed to said support base and that carries said first circuit terminal and integrally incorporates said sensing means, said sensing means comprising current sensing means, said first circuit terminal including a conductor portion disposed through said current sensing means, said conductor portion having a first section of narrowed cross section about which said current sensing means is disposed.

2. The switch of claim 1 wherein said sensing means further comprises voltage-sensing means being disposed within said molded insulating support between said first terminal and said support base.

3. The multi-pole switch of claim 2 further comprising disconnect means for selectively connecting and disconnecting said first circuit terminal with respect to a first of said separable contacts, said disconnect means comprising a first disconnect contact carried by and connected to said first circuit terminal and a second disconnect contact arranged to cooperate with said first disconnect contact and connected to said first separable contact.

4. The switch of claim 2 further comprising disconnect means for selectively connecting said first circuit terminal to a first of said separable contacts.

5. The switch of claim 3 wherein said disconnect means comprises a first disconnect contact connected to said first circuit terminal and a second disconnect contact arranged to cooperate with said first disconnect contact and connected to said first separable contact.

6. The switch of claim 5 wherein said insulating and supporting means further comprises an interrupter housing fabricated from insulating material that houses said separable contacts and carries said second disconnect contact.

7. The switch of claim 6 further comprising means for rotatably mounting said interrupter housing with respect to said support base.

8. The switch of claim 2 wherein said sensing means further comprises electrical connecting mean outputting sensed parameter signals at a predetermined point of said support base.

9. The switch of claim 8 wherein said electrical connecting means further comprises means for communicating said sensed parameter signals from said molded insulating support and along said support base to said predetermined point.

10. The switch of claim 9 wherein said communicating means includes signal conductor means and means for enclosing said signal conductor means.

11. The switch of claim 10 further comprising means for supporting said support base, said electrical connecting means further comprising means for connecting said sensed parameter signals to a predetermined point on said support base supporting means.

12. The switch of claim 11 wherein said supporting means comprises a tubular support member and said connecting means comprises electrical conductors disposed within said tubular support member.

13. The switch of claim 1 wherein said insulating and supporting means further comprises means for insulating said first and second circuit terminals with respect to each other.

14. The switch of claim 13 wherein said insulating and supporting means further comprises means for insulating said separable contacts with respect to each other when said separable contacts are in a predetermined separated position.

15. A multi-pole switch comprising:

a plurality of switch-pole units each of which includes means for defining separable contact and means for separating and connecting said separable contacts;

means for supporting said plurality of switch-pole units;

circuit-parameter sensing means incorporated within one or more of said plurality of switch-pole units for providing output signals at a predetermined location of said one or more switch-pole units; and means carried by said supporting means for communicating said output signals to a predetermined point of said supporting means, each of said switch-pole units comprising first and second circuit terminals and a molded insulating support, said molded insulating support carrying said first circuit terminal, said circuit-parameter sensing means being incorporated within said molded insulating support, said circuit-parameter sensing means comprising current sensing means, said first circuit terminal including a conductor portion disposed through said current sensing means, said conductor portion having a first section of narrowed cross section about which said current sensing means is disposed, one or more of said circuit-parameter sensing means comprising voltage-sensing means.

16. The switch of claim 15 further comprising operator means having a drive output and drive train means responsive to said drive output for operating said plurality of switch-pole units.

17. The switch of claim 16 wherein one or more of said output signals are communicated to said operator means.

18. The switch of claim 17 wherein said operator means comprises means responsive to a power supply, said voltage-sensing means comprising means for supplying power to operate said operator.

* * * * *

UNITED STATES PATENT AND TRADEMARK OFFICE

CERTIFICATE OF CORRECTION

PATENT NO. : 5,103,111

DATED : April 7, 1992

INVENTOR(S) : Thomas J. Tobin, et al

It is certified that error appears in the above-identified patent and that said Letters Patent is hereby corrected as shown below:

On the title page: Item [75]
Omitted one inventor's name -- Roy T. Swanson --.

Col. 3, line 13, "like In" should be -- like. In -- (insert period).

Col. 3, line 46, "46 The" should be -- 46. The -- (insert period).

Col. 4, lines 50-51, "li-ke" should be -- like -- (no hyphenation).

Col. 5, line 12, "38," should be -- 38' --.

Col. 6, line 6, claim 5, "3" should be -- 4 --.

Col. 6, line 20, claim 8, "mean" should be -- means for --.

Col. 6, line 51, claim 15, "contact" should be -- contacts --.

Signed and Sealed this

Twenty-second Day of June, 1993

*Attest:*

Michael K. Kirk

MICHAEL K. KIRK

*Attesting Officer*

*Acting Commissioner of Patents and Trademarks*